US005298198A

United States Patent [19]

LaCrosse

[11] Patent Number: 5,298,198

[45] Date of Patent: Mar. 29, 1994

[54] AERATOR

[75] Inventor: Gaylen R. LaCrosse, Brussels, Wis.

[73] Assignee: JLBD, Inc., Brussels, Wis.

[21] Appl. No.: 63,009

[22] Filed: May 17, 1993

[51] Int. Cl.[5] ..... B01F 3/04

[52] U.S. Cl. ..... 261/76; 261/DIG. 75

[58] Field of Search ..... 261/76, DIG. 75

[56] References Cited

U.S. PATENT DOCUMENTS

| | | | |
|---|---|---|---|
| 1,784,222 | 12/1930 | Chrickmer | 261/76 |
| 2,103,067 | 12/1936 | Evans | 261/76 |
| 2,224,605 | 12/1940 | Miller | 261/DIG. 75 |
| 2,849,217 | 8/1958 | Bachli et al. | 261/76 |
| 3,257,180 | 6/1966 | King | 48/180 |
| 4,098,851 | 7/1978 | Schulte et al. | 261/76 |
| 4,210,534 | 7/1980 | Molvar | 210/220 |
| 4,264,039 | 4/1981 | Moreland | 261/DIG. 75 |
| 4,308,138 | 12/1981 | Woltman | 261/DIG. 75 |
| 4,593,420 | 6/1986 | Tobias et al. | 261/DIG. 75 |
| 4,885,084 | 12/1989 | Doyle | 210/132 |
| 4,973,432 | 11/1990 | Desjardins et al. | 261/76 |
| 5,169,293 | 12/1992 | Yamamoto | 261/DIG. 75 |

*Primary Examiner*—Tim Miles

*Attorney, Agent, or Firm*—Lathrop & Clark

[57] ABSTRACT

A plastic housing has an inlet for the entrance of liquid containing contaminants and an outlet for the exit of aerated liquid and an air inlet located therebetween. An inlet nozzle is located in the housing between the liquid inlet and the air inlet. The nozzle has a bore with a flared inlet and a substantially cylindrical exit portion which discharges at an exit face. A discharge nozzle is located in the housing between the air inlet and the liquid outlet, and has a bore which is flared towards the inlet nozzle and which has a substantially cylindrical exit portion of a diameter greater than that of the inlet bore exit portion. Contaminated water from a wastewater source such as a swimming pool, hot tub, or swine manure pond may be passed under pressure through the aerator, mixed with air in an expansion chamber formed between the inlet nozzle and discharge nozzle and the housing, and may take place at relatively low flow rates and pressures. The expansion chamber has an annular portion which extends around the segments of pipe containing the inlet and discharge nozzles and communicates with a generally cylindrical volume extending between the inlet nozzle and the discharge nozzle.

10 Claims, 2 Drawing Sheets

AERATOR

FIELD OF THE INVENTION

The present invention relates to apparatus for mixing gases and liquids in general and to apparatus for aerating contaminated liquids to promote oxidization and purification in particular.

BACKGROUND OF THE INVENTION

Standards for the purity of water in rivers, lakes and groundwater are continually increasing in response to legislation, regulation, and community demand. These increasingly stringent standards place a burden on the producers of wastewaters for example, users of pools and spas, agribusiness operators and others, to discharge wastewater which does not introduce prohibited levels of contaminants or chemicals into the surroundings and groundwater.

Due to the strict regulations, maintenance of water purity by the use of chemical additives such as chlorine in pools and spas has become less desirable.

It is common under many state and federal regulatory regimes that any unauthorized discharge of organic or inorganic waste, or bacteriologically contaminated materials, which exceed regulatory levels must be immediately reported to the authorities.

Although transportation of contaminated wastewater to off-site authorized disposal facilities is permitted, such transportation is in most circumstances prohibitively expensive especially where large volumes of wastewater are involved. If the contaminated wastewater is categorized as hazardous, prior authorization and permitting may be required.

Rural, residential and agribusiness sources of wastewater which are not connected with city sewers are particularly in need of low cost wastewater treatment systems, especially systems which may operate on relatively small volumes of wastewater. However, even those wastewater generators connected to city sewers are increasingly being required to pretreat wastewater prior to discharge.

Wastewater contains biochemical oxygen demand (BOD), ammonia nitrates, phosphorous, bacteria and virus. Prior art systems have introduced chemical agents, particularly chlorine, ozone, or a combination thereof, to oxidize and purify the wastewater. Inorganic contaminants are oxidized to less soluble oxides and organic components are converted to carbonaceous residuals and carbon dioxide. Conventional aerators and injectors utilize pressure and velocity changes of the wastewater flow to introduce air, oxygen or ozone as a vast quantity of small bubbles ranging in size from about 40 microns to 0.5 microns in diameter. However, prior art injectors typically require high pressures or high flow rates to achieve effective aeration.

What is needed is a wastewater and liquid treatment aeration system which reduces objectionable contaminants to an acceptable level and which may be economically operated at slow flow rates or low pressures.

SUMMARY OF THE INVENTION

The aerator of this invention has a plastic housing with an inlet for the entrance of liquid containing contaminants and an outlet for the exit of aerated liquid. An air inlet is located in the housing between the liquid inlet and liquid outlet. An inlet nozzle is located in the housing between the liquid inlet and the air inlet, and has an entrance face and a bore which extends through the nozzle to an exit face. The bore has a substantially cylindrical exit portion which discharges at the exit face and an inlet portion which is flared towards the housing liquid inlet and of a decreasing diameter. The discharge nozzle is located in the housing between the air inlet and the liquid outlet, and has an entrance face and a bore which extends through the discharge nozzle to an exit face. The bore has a substantially cylindrical exit portion of a diameter greater than that of the inlet bore exit portion. The discharge nozzle bore is flared towards the inlet nozzle. Contaminated water from a wastewater source such as a swimming pool, hot tub, or swine manure pond may be passed under pressure through the aerator, mixed with air in an expansion chamber formed between the inlet nozzle and discharge nozzle and the housing, and may take place at relatively low flow rates and pressures. The expansion chamber has an annular portion which extends around the segments of pipe containing the inlet and discharge nozzles and communicates with a generally cylindrical volume extending between the inlet nozzle and the discharge nozzle.

It is an object of the present invention to provide an apparatus for treating wastewater which may be operated at relatively low water pressures to effectively aerate contaminated water.

It is a further object of the present invention to provide an aerator which is economical to operate.

It is also an object of the present invention to provide an apparatus which contributes to the reduction of BOD, ammonia nitrates, phosphorous, bacteria and virus to acceptable levels.

Further objects, features, and advantages of the present invention will become apparent from the following detailed description of the invention when taken in conjunction with the accompanying drawing.

DESCRIPTION OF THE PREFERRED EMBODIMENT

Figure 1:
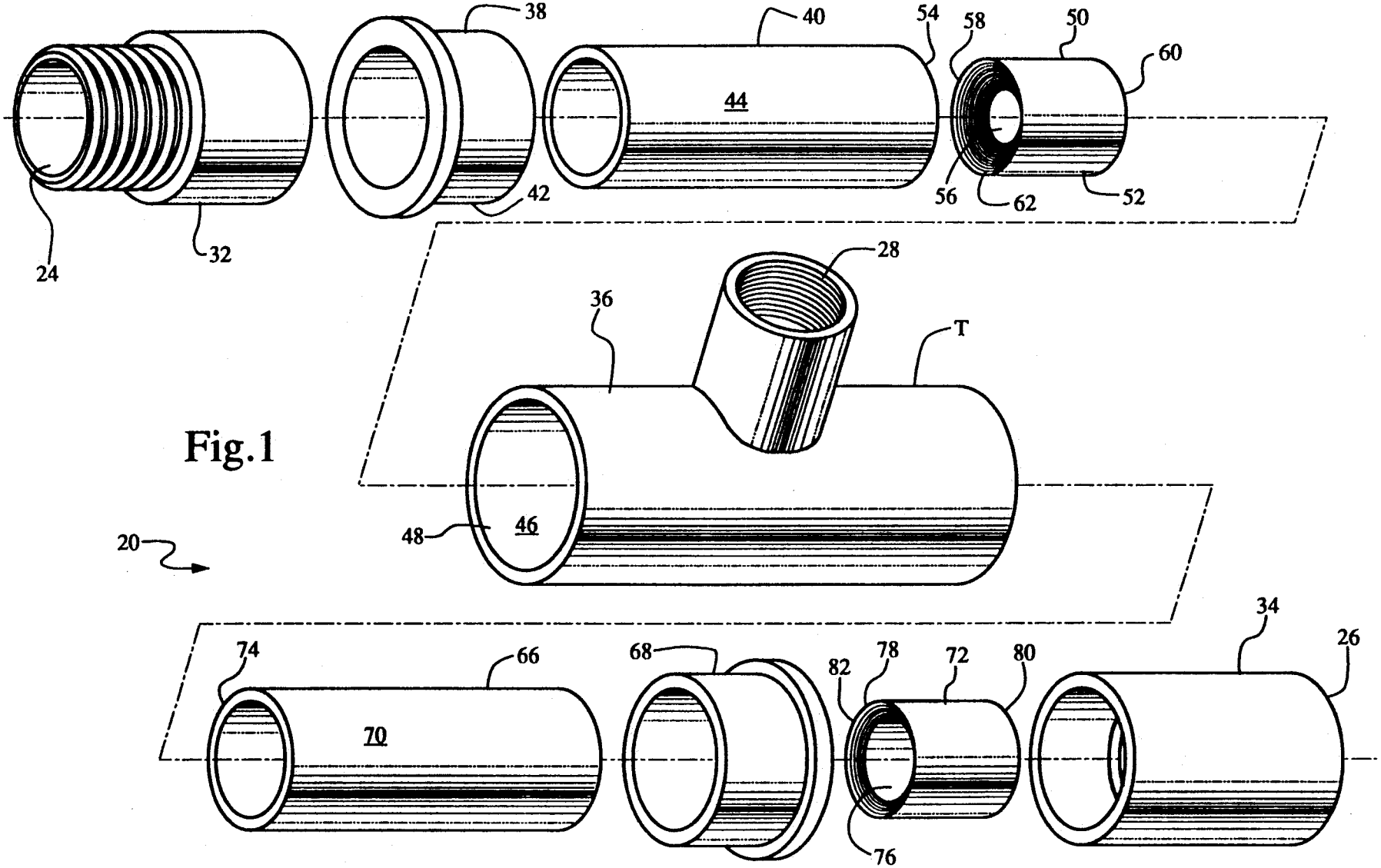
FIG. 1 is an exploded perspective view of the aerator of the present invention.

Referring more particularly to FIGS. 1-6, wherein like numbers refer to similar parts, an aerator 20 is shown in FIG. 1. The aerator 20 may be used in a variety of fluid treatment applications. The aerator has a corrosion resistant housing 22 preferably formed of conventional PVC pipe fittings, although alternatively molded as a unitary part. The housing 22 has a liquid inlet 24 and a liquid outlet 26. An air inlet 28 is located between the liquid inlet 24 and liquid outlet 26. The aerator 20 may be installed in a fluid treatment system having various additional pumps, filters, and piping. However, in all cases a supply of fluid containing contaminants 30 which is under pressure will be connected to the liquid inlet 24. The contaminated liquid may constitute water containing human or animal wastes, pool or hot tub discharges, agricultural wastewater or other substance to be treated.

For convenient attachment of the aerator 20 to connecting PVC piping, the housing 22 is provided with a male adapter 32 which defines the liquid inlet and a female adapter 34 which defines the liquid outlet. Depending on the requirements of the system, the location of the adapters 32, 34 may be switched. A T-fitting 36 which includes the air inlet 28 extends between the male adapter 22 and female adapter 34. A flanged inlet bushing 38 extends into the T-fitting 36. An inlet tube 40 extends partially into the male adapter 32 and through the inlet bushing 38 into the T-fitting 36. The cylindrical wall 42 of the inlet bushing 38 spaces the exterior surface 44 of the inlet tube 40 from the cylindrical interior surface 46 of the central passage way 48 of the T-fitting 36.

Figure 2:
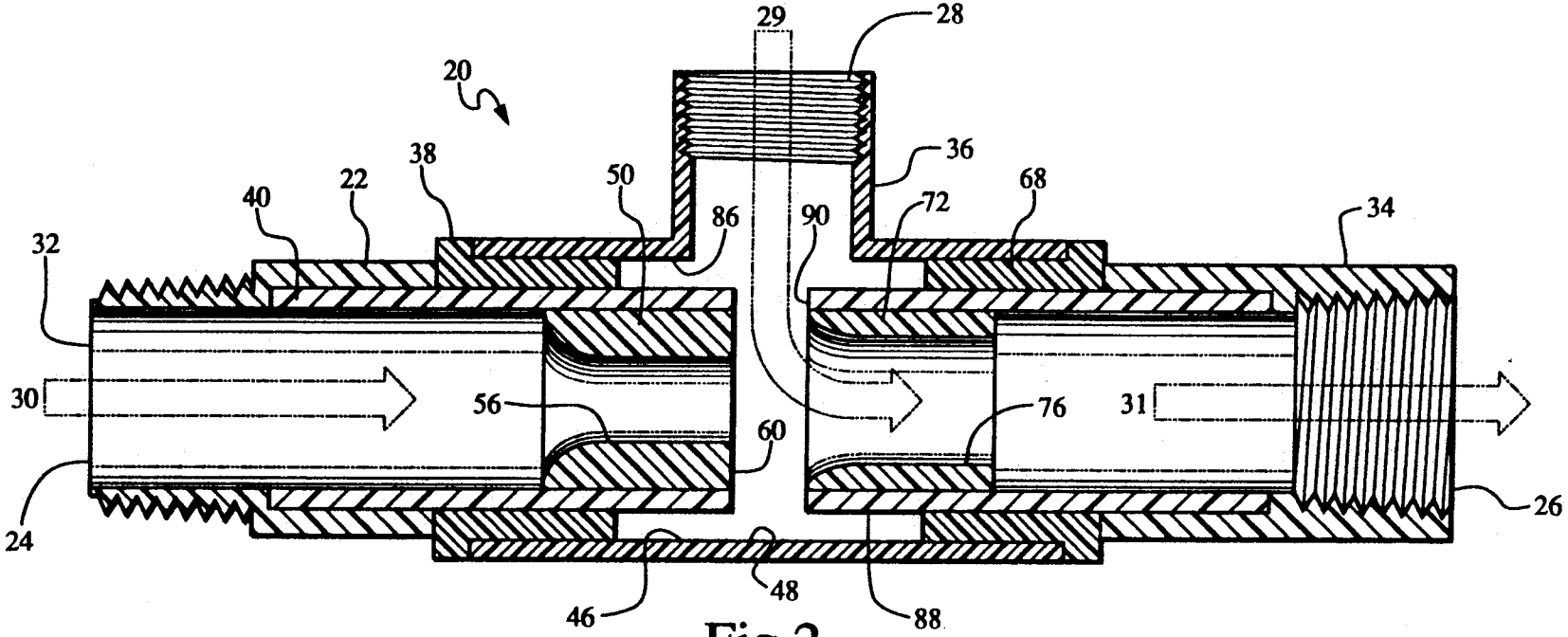
FIG. 2 is a cross-sectional view of a the aerator of FIG. 1 with fluid flows indicated schematically.
Figure 6:
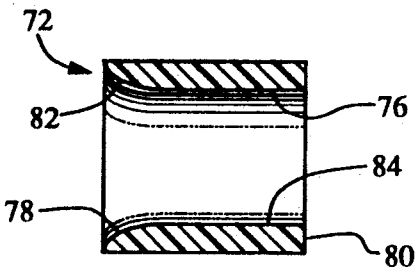
FIG. 6 is a cross-sectional view of the discharge nozzle of FIG. 5 taken along section line 5—5.
Figure 5:
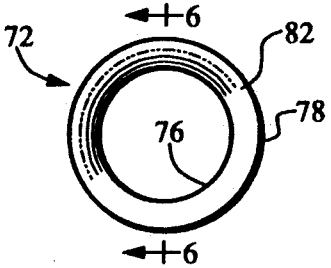
FIG. 5 is a front elevational view of the discharge nozzle of the aerator of FIG. 1.

A plastic inlet nozzle 50 with a cylindrical exterior surface 52 is fixed within the inlet tube 44 adjacent the outlet end 54 of the inlet tube. The inlet nozzle 50, as best shown in FIG. 2, is adhesively attached or welded to the interior of the inlet tube 40 such that all liquid entering the aerator 20 must pass through the inlet nozzle 50.

Figure 4:
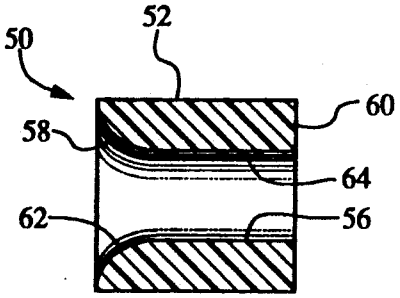
FIG. 4 is a cross-sectional view of the inlet nozzle of FIG. 3 taken along section line 4—4.
Figure 3:
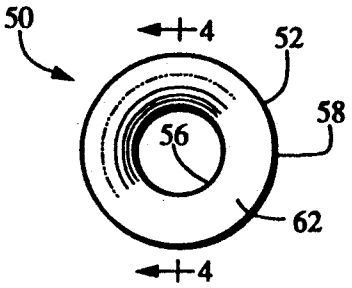
FIG. 3 is a front elevational view of the inlet nozzle of the aerator of FIG. 1.

As best shown in FIGS. 3 and 4, the inlet nozzle 50 is a machined or molded cylindrical block of plastic having an entrance face 58 which opens on the liquid inlet 24 and an exit face 60 which faces the air inlet 28. A bore 56 extends between the entrance face 58 and exit face 60. The inlet nozzle bore 56 has a flared inlet portion 62 which defines the entrance face 58 and which has a surface which is generally semitoroidal. In a preferred embodiment, the radius of the flared inlet portion 62 is approximately $\frac{1}{3}$ the diameter of the inlet nozzle 50. The inlet portion 62 of the bore 56 narrows to a cylindrical exit portion 64 which discharges to the exit face 60 of the inlet nozzle 50. The exit portion 64 intersects the exit face at a right angle. In a preferred embodiment, the cylindrical exit portion 64 of the bore is approximately $\frac{1}{4}$ of the diameter of the inlet nozzle 50. Hence the diameter of the fluid passage within the nozzle at its narrowest is one half the internal diameter of the inlet pipe 40. Preferably, the inlet tube 40 has an internal diameter which is between 190 and 210 percent of the diameter of the inlet nozzle bore exit portion 64.

As shown in FIG. 1, a discharge tube 66 extends through a flanged discharge bushing 68 into the female adapter 34. The discharge bushing 68 spaces the exterior surface 70 of the discharge tube 66 from the interior surface 46 of the T-fitting central passageway 48. A machined or molded discharge nozzle 72 is connected within the discharge tube adjacent the inlet end 74 of the discharge tube 66.

The discharge nozzle is a cylindrical block of plastic having a bore 76 which extends therethrough. The bore extends from an entrance face 78 which opens towards the inlet nozzle 50 to an exit face 80 which faces the liquid outlet 26. The discharge nozzle bore 76 has a flared inlet portion 82 with a surface which corresponds to the entrance face 78 and which is substantially semitoroidal. The radius of the flared inlet portion of the bore in a preferred embodiment is also approximately $\frac{1}{3}$ the diameter of the discharge nozzle. The discharge nozzle bore has a cylindrical exit portion 84 is continuous with the flared entrance portion 78. The diameter of the discharge nozzle exit portion 84 is greater than the diameter of the inlet nozzle 50 exit portion 64. In a preferred embodiment, the discharge nozzle bore exit portion 84 which is approximately $\frac{3}{4}$ the diameter of the discharge nozzle. It should be noted that although the radius of the semitoroidal surfaces of the inlet nozzle 50 and discharge nozzle 72 are in a preferred embodiment equivalent, the geometry of the two exit faces 60, 80 is not congruent, as they represent segments of tori having different diameters.

As best shown in FIG. 2, an expansion chamber 86 is formed beneath the air inlet 28 of the T-fitting 36 and between the portions of the inlet tube 40 and the discharge tube 66 which extend from the inlet bushing 38 and discharge bushing 68 within the central passageway 48 of the T-fitting 36.

The expansion chamber 86 has an annular region or volume 88 defined between the interior surface 46 of the T-fitting central passageway 48 and the exterior surfaces of the inlet tube 40 and discharge tube 66. The expansion chamber annular region 88 has an exterior diameter which is between 160 percent and 180 percent of the diameter of the inlet nozzle bore exit portion. The expansion chamber further comprises a gap 90 between the exit face 60 of the inlet nozzle 50 and the entrance face 78 of the discharge nozzle 72. The air inlet discharges directly into the gap 90.

The width of the gap 90 is preferably between 90 percent and 140 percent of the diameter of the inlet nozzle bore exit portion 64.

As liquid flows through the central passageway 48 of the T-fitting 36 air is drawn through the inlet from atmosphere or a connected air conduit or air supply (not shown).

The aerator 20 operates to cause intensive and effective mixing of the air 29 with the contaminated liquid 30 within the expansion chamber 86. Contaminated liquid 30 is introduced to the aerator 20 through the liquid inlet 24. The liquid 30 flows through the female adapter 34 and into the inlet tube 40. As the opening diameter through which the fluid must pass is constricted greatly by the inlet nozzle 50, the velocity of the contaminated fluid increases as it passes through the inlet nozzle 50. At the exit face 60 of the nozzle 50 the fluid is instantaneously disgorged into the expansion chamber 86 which is open to atmospheric pressure directly or indirectly through the air inlet 28. The turbulence and pressure drop facilitates the formation of very small diameter air bubbles within the fluid which is then forced into the discharge nozzle 72 which narrows in diameter with a resultant increase in the velocity of the air-fluid mixture 31. The aerator 20 has been found to be particularly effective at entraining air even at relatively low inlet fluid pressures. For example, an aerator 22, having inlet and discharge nozzles 50, 72, of an exterior diameter of 1.047 inches with an inlet bore exit portion 64 diameter of 0.50 inches and a discharge nozzle bore exit portion 84 diameter of 0.75 inches located within a T-fitting having a central passage diameter of approximately 1.75 inches with a space between the inlet tube and the exit tube of 0.50 inches yielded the following rates of injection of air for the given flow rates of fluid and inlet pressure shown in Table 1.

TABLE 1

| Fluid flow rate in gallons per minute | Inlet Pressure Pounds Per Square Inch Gauge | Air by natural injection in standard cubic feet per minute |
|---|---|---|
| 27.5 | 25 | 12.26 |

TABLE 1-continued

| Fluid flow rate in gallons per minute | Inlet Pressure Pounds Per Square Inch Gauge | Air by natural injection in standard cubic feet per minute |
|---|---|---|
| 25.0 | 17 | 9.54 |
| 22.5 | 17 | 8.99 |
| 20.0 | 13 | 7.08 |
| 17.5 | 11 | 5.99 |
| 15.0 | 9 | 5.45 |
| 12.5 | 8 | 4.09 |
| 10.0 | 7 | 3.82 |
| 7.5 | 6 | 0.44 |
| 5.0 | 4 | 0.27 |

By effectively aerating water at low pressures, the aerator 20 may be fabricated of lower cost materials such as PVC pipe which need not be able to withstand extremely high pressures. Furthermore, such an aerator may be effectively utilized without the need for high pressure pumps. For example, the aerator 20 may be employed within the recirculation stream of a domestic swimming pool or hot tub. Effective aeration removes or reduces the BOD, ammonia nitrates, phosphorous, bacteria and virus. As high pressures are not required to operate the aerator 20, it may be operated by the low capacity pumps commonly associated with hot tubs and swimming pools.

The aerator 20 may also, for example, be used in conjunction with agricultural waste treatment. The contents of a swine manure holding pond, for example, may be processed through the aerator 20 or a bank of such aerators, to reduce the contaminant contents to acceptable levels and reduce objectionable odors.

It should be noted that where the term air has been used in this application, atmospheric air, compressed air, enriched air, oxygen, ozone, or combinations thereof are included.

It is understood that the invention is not confined to the particular construction and arrangements of parts herein illustrated and described, but embraces such modified forms thereof and come within the scope of the following claims.

I claim:

1. An aerator for treatment of contaminated liquid, comprising:

a) a housing having a generally cylindrical interior and an inlet for the entrance of liquid, and an outlet for the exit of liquid;

b) an air inlet located in the housing between the liquid inlet and liquid outlet;

c) an inlet nozzle located in the housing between the liquid inlet and the air inlet, the inlet nozzle having an entrance face and a bore which extends through the nozzle to an exit face, wherein the bore has a substantially cylindrical exit portion of a first diameter which discharges at the exit face, and wherein the bore has an inlet portion of a second greater diameter than the first diameter and said bore is flared towards the housing liquid inlet, the bore inlet portion being joined to the bore exit portion and providing a smooth transition from said second diameter to said first diameter;

d) a discharge nozzle located in the housing between the air inlet and the liquid outlet, the discharge nozzle having an entrance face and a bore which extends through the discharge nozzle to a discharge nozzle exit face, wherein the discharge bore has a substantially cylindrical exit portion of a third diameter which discharges at the discharge nozzle exit face, and wherein the discharge nozzle bore has an inlet portion of a fourth diameter which is greater than the third diameter and which is flared towards the inlet nozzle, and wherein the third diameter is greater than the first diameter; and e) an expansion chamber defined within the housing beneath the air inlet and between the inlet nozzle and the discharge nozzle, the expansion chamber having a gap between the inlet nozzle and the discharge nozzle which communicates with an annular region defined between the nozzles and the interior of the housing.

2. The apparatus of claim 1 wherein the inlet comprises an inlet tube which has an internal diameter which is between 190 and 210 percent of the diameter of the inlet nozzle bore exit portion.

3. The apparatus of claim 1 wherein the inlet nozzle exit face is spaced a distance from the discharge nozzle inlet face which is between 90 percent and 140 percent of the diameter of the inlet nozzle bore exit portion.

4. The apparatus of claim 1 wherein the expansion chamber annular region has an exterior diameter which is between 160 percent and 180 percent of the diameter of the inlet nozzle bore exit portion.

5. The apparatus of claim 1 wherein diameter of the discharge nozzle bore exit portion is between 140 percent and 160 percent of the diameter of the inlet nozzle bore exit portion.

6. An apparatus for treatment of contaminated water, comprising:

a) a housing having an inlet for entrance of contaminated water, an outlet for the exit of treated water, and an inlet for air located between the liquid inlet and the liquid outlet;

b) an inlet nozzle located within the housing between the liquid inlet and the air inlet, the inlet nozzle having a bore which extends therethrough and which has an inlet portion which is flared and of greater diameter than an exit portion;

c) a discharge nozzle located within the housing between the liquid outlet and the air inlet and which has an exit portion which has a diameter greater than the diameter of the inlet nozzle bore exit portion; and d) an expansion chamber located within the housing and defined between the inlet nozzle and the discharge nozzle and beneath the air inlet, wherein the inlet chamber has a generally cylindrical gap between the inlet nozzle and the outlet nozzle, the width of the gap being between 90 and 140 percent of the diameter of the inlet nozzle exit portion.

7. The apparatus of claim 6 wherein the inlet comprises an inlet tube which has an internal diameter which is between 190 and 210 percent of the diameter of the inlet nozzle bore exit portion.

8. The apparatus of claim 6 wherein the expansion chamber annular region has an exterior diameter which is between 160 percent and 180 percent of the diameter of the inlet nozzle bore exit portion.

9. The apparatus of claim 6 wherein the diameter of the discharge nozzle bore exit portion is between 140 percent and 160 percent of the diameter of the inlet nozzle bore exit portion.

10. An apparatus for treatment of wastewater, comprising:

(a) a T-fitting having a cylindrical interior central passage of a first diameter;

(b) a cylindrical inlet tube having an exterior of a second diameter, wherein said second diameter is less than said first diameter;

(c) a flanged cylindrical inlet bushing having an interior of said second diameter and an exterior of said first diameter, wherein the inlet tube is engaged within the inlet bushing, and the inlet bushing is engaged with the T-fitting central passage;

(d) an inlet nozzle fixed within the inlet tube, the nozzle having a bore extending therethrough which has an inlet portion which makes a smooth transition to an exit portion of a third diameter which is less than said second diameter;

(e) a flanged discharge bushing engaged with the T-fitting central passage and spaced from the inlet nozzle;

(f) a cylindrical discharge tube, engaged within the discharge bushing and having an exterior diameter which is less than the first diameter, portions of the discharge tube thus being spaced inwardly from the T-fitting interior central passage;

(g) a discharge nozzle fixed within the discharge tube and facing the inlet nozzle within the T-fitting;

(h) an air inlet in the T-fitting located above and between the inlet nozzle and the discharge nozzle;

(i) an expansion chamber defined between the inlet nozzle and the discharge nozzle, the expansion chamber having an annular portion which encompasses the volume defined between the exterior of each of the inlet tube and the discharge tube and the T-fitting central passage, and further includes a generally cylindrical volume gap between the inlet nozzle and the discharge nozzle.

* * * * *